US012331454B2

(12) United States Patent
Cha et al.

(10) Patent No.: US 12,331,454 B2
(45) Date of Patent: Jun. 17, 2025

(54) DRYER AND METHOD FOR CONTROLLING THE SAME

(71) Applicant: SAMSUNG ELECTRONICS CO., LTD., Suwon-si (KR)

(72) Inventors: Hyemin Cha, Suwon-si (KR); Changbae Yeom, Suwon-si (KR); Yeonju Lee, Suwon-si (KR); Kisu Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 686 days.

(21) Appl. No.: 17/668,028

(22) Filed: Feb. 9, 2022

(65) Prior Publication Data

US 2022/0170199 A1 Jun. 2, 2022

Related U.S. Application Data

(63) Continuation of application No. PCT/KR2021/015035, filed on Oct. 25, 2021.

(30) Foreign Application Priority Data

Nov. 20, 2020 (KR) ..... 10-2020-0156580
May 31, 2021 (KR) ..... 10-2021-0070376

(51) Int. Cl.
*D06F 58/38* (2020.01)
*D06F 34/04* (2020.01)
(Continued)

(52) U.S. Cl.
CPC ..... *D06F 58/38* (2020.02); *D06F 34/04* (2020.02); *D06F 34/28* (2020.02); *D06F 58/08* (2013.01);
(Continued)

(58) Field of Classification Search
None
See application file for complete search history.

(56) References Cited

U.S. PATENT DOCUMENTS 2,627,669 A * 2/1953 Candor ..... D06F 58/206 62/331
10,246,240 B1 * 4/2019 Sadaghiani ..... F26B 25/12
(Continued)

FOREIGN PATENT DOCUMENTS

EP 2684994 A1 1/2014
EP 2 684 994 B1 9/2016
(Continued)

OTHER PUBLICATIONS

International Searching Authority dated Feb. 24, 2022 in PCT/KR2021-015035.
(Continued)

*Primary Examiner* — David J Laux
(74) *Attorney, Agent, or Firm* — STAAS & HALSEY LLP

(57) ABSTRACT

A dryer includes a main body having an opening for an object to be dried to be entered therethrough, a drum arranged inside the main body for accommodating the object entered through the opening, a door opening or closing the opening, an input device configured to receive an input to perform a dehumidification mode, and output a control signal corresponding to the received input, a heat exchanger heating air supplied to the drum, a fan forming a flow of air along a fluid path connected to the drum through the heat exchanger from outside of the main body, and a controller configured to control the fan to introduce air from the outside of the main body to flow along the fluid path in response to the control signal received from the input device.

14 Claims, 13 Drawing Sheets

(51) Int. Cl.

| | |
|---|---|
| ***D06F 34/28*** | (2020.01) |
| ***D06F 58/08*** | (2006.01) |
| ***D06F 58/26*** | (2006.01) |
| ***D06F 103/40*** | (2020.01) |
| ***D06F 103/46*** | (2020.01) |
| ***D06F 105/30*** | (2020.01) |
| ***D06F 105/46*** | (2020.01) |
| ***D06F 105/58*** | (2020.01) |

(52) U.S. Cl.
CPC ..... *D06F 58/26* (2013.01); *D06F 2103/40* (2020.02); *D06F 2103/46* (2020.02); *D06F 2105/30* (2020.02); *D06F 2105/46* (2020.02); *D06F 2105/58* (2020.02)

(56) References Cited

U.S. PATENT DOCUMENTS

| | | | | |
|---|---|---|---|---|
| 2008/0276484 | A1* | 11/2008 | Dewald, III | D06F 58/26 34/80 |
| 2009/0094852 | A1* | 4/2009 | Tatsumi | D06F 58/206 34/132 |
| 2012/0227279 | A1* | 9/2012 | Dewald, III | F26B 21/083 34/80 |
| 2014/0067131 | A1* | 3/2014 | Park | D06F 34/05 700/275 |
| 2015/0299935 | A1* | 10/2015 | Park | D06F 58/38 34/493 |
| 2018/0171523 | A1* | 6/2018 | Han | D06F 58/20 |
| 2018/0305851 | A1* | 10/2018 | Kwon | H04L 12/2825 |
| 2019/0040569 | A1* | 2/2019 | Uchikoshi | D06F 73/00 |
| 2020/0051557 | A1* | 2/2020 | Shin | G10L 15/26 |
| 2020/0149212 | A1* | 5/2020 | Kim | D06F 37/42 |
| 2020/0208318 | A1* | 7/2020 | Chae | D06F 37/28 |

FOREIGN PATENT DOCUMENTS

| | | | |
|---|---|---|---|
| EP | 3 392 396 | A1 | 10/2018 |
| JP | 2004-340407 | A | 12/2004 |
| JP | 2007-68870 | A | 3/2007 |
| JP | 2007-68871 | | 3/2007 |
| JP | 2007-143711 | A | 6/2007 |
| JP | 2007-319458 | A | 12/2007 |
| JP | 2008104625 | | 5/2008 |
| JP | 5014378 | | 8/2012 |
| JP | 5289171 | | 9/2013 |
| KR | 10-0595763 | B1 | 6/2006 |
| KR | 10-2013-0005724 | | 1/2013 |
| KR | 10-2018-0084545 | A | 7/2018 |
| KR | 10-2019-0065151 | A | 6/2019 |

OTHER PUBLICATIONS

European Search Report dated Nov. 27, 2023 issued in European Application No. EP 21 89 4922.

* cited by examiner

DRYER AND METHOD FOR CONTROLLING THE SAME

CROSS-REFERENCE TO RELATED APPLICATIONS

This application is a continuation application, under 35 U.S.C. § 111(a), of international application No. PCT/KR2021/015035, which claims priority to Korean patent application No. 10-2020-0156580, filed Nov. 20, 2020 and Korean patent application No. 10-2021-0070376, filed May 31, 2021, the entire disclosures of all of which are herein incorporated by reference as a part of this application.

1. FIELD

The disclosure relates to a dryer, and more particularly, to a dryer for dehumidifying air outside the dryer in addition to drying an object to be dried.

2. DESCRIPTION OF RELATED ART

A dryer is an apparatus for drying clothes (hereinafter, referred to as an object to be dried) by spinning a drum that accommodates the object to be dried and supplying hot air into the drum.

The existing dryer is installed and used in a washing room or a utility room separately partitioned off in the house, but the washing room or the utility room has no window and is narrow and small, thereby having bad ventilation. When the washing room or the utility room has high humidity, the dryer installed therein is more likely to be corroded, giving an unpleasant feeling to the user going in and out of the space. An extra dehumidifier may be installed in the space where the dryer is installed, but it is inefficient in terms of costs and spatial use.

In the meantime, heat pump dryers may dry the object to be dried using a refrigerant cycle. The aforementioned problems may be solved all at once by properly utilizing characteristics of the refrigerant cycle, although an essential function of the dryer is to dry the object to be dried.

SUMMARY

According to an aspect of the disclosure, a dryer includes a main body having an opening for an object to be dried to be entered therethrough, a drum arranged inside the main body to accommodate the object entered thorough the opening, a door opening or closing the opening, an input device configured to receive an input to perform a dehumidification mode and output a control signal corresponding to the received input, a heat exchanger heating air supplied to the drum; a fan forming a flow of air along a fluid path connected to the drum through the heat exchanger from outside of the main body, and a controller configured to control the fan to introduce air from the outside of the main body to flow along the fluid path in response to the control signal received from the input device.

In an embodiment, the dryer may further include a door sensor configured to detect an open/close state of the door, and outputting a door open signal or a door close signal in response to to the detected state of the door, and the controller may control the fan based on the door open signal or the door close signal received from the door open/close sensor.

In an embodiment, the dryer may further include a door opening device opening the door, and the controller may control the door opening device in response to the control signal received from the input device.

In an embodiment, the dryer may further include a dehumidification unit comprises a first fluid path to guide the introduced air from the outside of the main body to the heat exchanger and a second fluid path to guide air discharged from the drum to the heat exchanger.

In an embodiment, the dehumidification unit further includes a fluid path guide in a first position to provide the first fluid path or in a second position to provide the second fluid path; and a fluid path position detecting sensor configured to detect a position of the fluid path guide and output a fluid path position detection signal to detect a position of the fluid path guide, and the controller may control the fan based on the position detection signal received from the fluid path position detecting sensor.

In an embodiment, the dryer may further include a fluid path position switching device configured to move the fluid path guide from the first position to the second position or from the second position to the first position, and the controller may control the fluid path position switching device in response to the control signal received from the input device.

In an embodiment, the dryer may further include a display device to display operation information of the dryer, and the controller may control the display device to display information about the detected state of the door based on the door open signal or the door close signal received from the door sensor.

In an embodiment, the dryer may further include a motor providing power to rotate the drum, and the controller may control the motor to rotate the drum in response to the control signal received from the input device.

In an embodiment, the dryer may further include a motor current sensor outputting a motor current signal corresponding to a current applied to the motor, and the controller may control the motor to stop rotation of the drum based on the motor current signal received from the motor current sensor.

In an embodiment, the dryer may further include a communication circuit communicating with an external server, and the controller may receive a remote control command from the external server in response to the control signal received from the input device.

According to an embodiment, a method for controlling a dryer including a main body having an opening for an object to be dried to be entered therethrough, a drum arranged inside the main body to accommodate the object to be dried entered through the opening, a door to open or close the opening, a heat exchanger to heat air supplied to the drum, a fan to form a flow of air along a fluid path connected to the drum through the heat exchanger from outside of the main body, and an input device to receive an input to the operate the dryer, comprises by the input device, receiving an input to perform a dehumidification mode and outputting a control signal corresponding to the received input; controlling the fan, by a controller, to introduce air from the outside of the main body to flow along the fluid path in response to the control signal received from the input device.

The dryer may further include a door sensor, and the method further comprises, by the door sensor, detecting an open/close state of the door and outputting a door open signal or the door close signal in response to the detected state of the door, and the method may further include controlling the fan, by the controller, based on the door open signal or the door close signal received from the door sensor.

The dryer may further include a door opening device to open the door, and the method may further include controlling the door opening device in response to the control signal received from the input device.

The dryer may further include a dehumidification unit includes a first fluid path to guide the introduced air from the outside of the main body to the heat exchanger and a second fluid path to guide air discharged from the drum to the heat exchanger.

The dehumidification unit may further include a fluid path guide in a first position to provide the first fluid path or in a second position to provide the second fluid path; and a fluid path position detecting sensor configured to detect a position of the fluid path guide, and outputting a fluid path position detection signal in response to the detected position of the fluid path guide, and the controlling of the fan further comprises controlling the fan based on the position detection signal received from the fluid path position detecting sensor.

The dryer may further include a fluid path position switching device configured to move the fluid path guide from the first position to the second position or from the second position to the first position, and the method may include controlling the fluid path position switching device in response to the control signal received from the input device.

The dryer may further include a display device to display operation information of the dryer, and the method may include controlling the display device to display information about the detected state of the door based on the door open signal or the door close signal received from the door sensor.

The dryer may further include a motor providing power to rotate the drum, and the method may include controlling the motor to rotate the drum in response to the control signal received from the input device.

The dryer may further include a motor current sensor outputting a motor current signal corresponding to a current applied to the motor, and the method may include controlling the motor to stop a rotation of the drum based on the motor current signal received from the motor current sensor.

The dryer may further include a communication circuit communicating with an external server, and the method may include receiving a remote control command from the external server in response to the control signal received from the input device.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
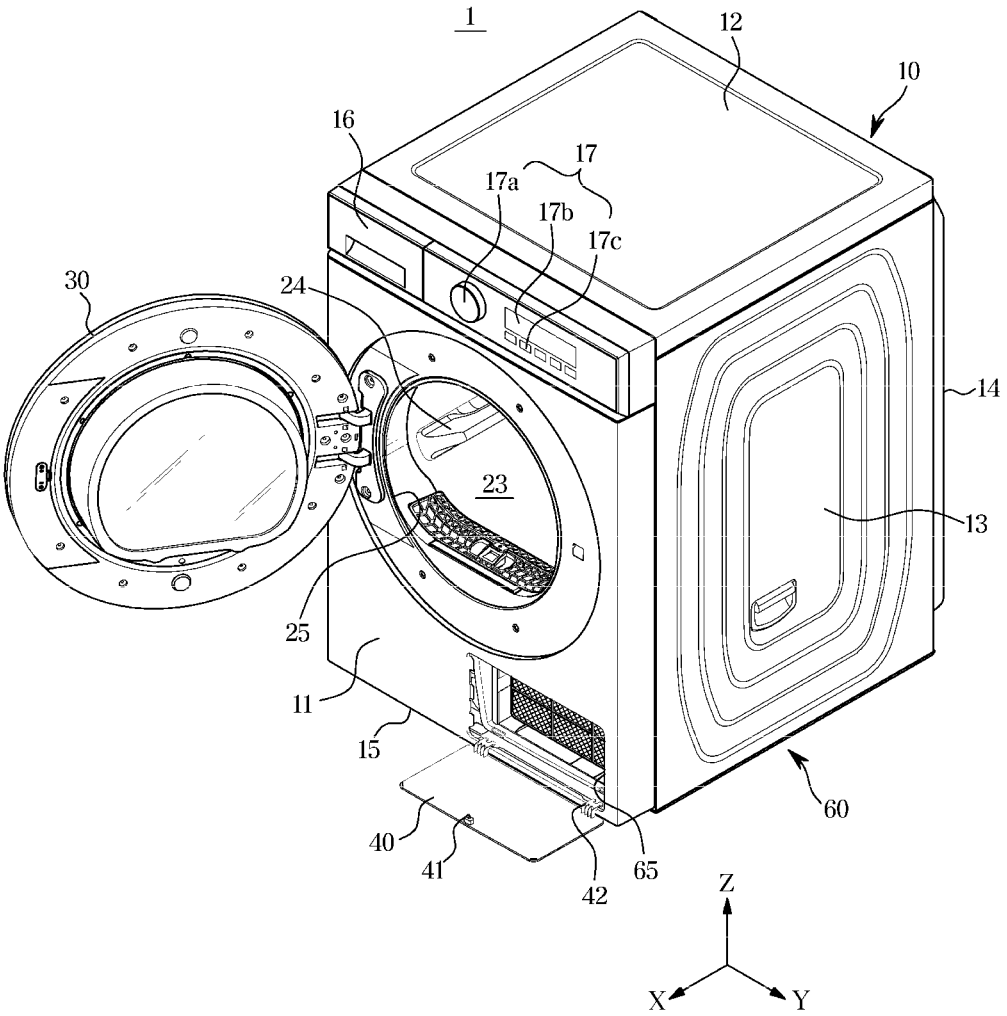
FIG. 1 is an exterior view of a dryer, according to an embodiment.

Like numerals refer to like elements throughout the specification. Not all elements of embodiments of the disclosure will be described, and description of what are commonly known in the art or what overlap each other in the embodiments will be omitted. The term 'unit, module, member, or block' may refer to what is implemented in software or hardware, and a plurality of units, modules, members, or blocks may be integrated in one component or the unit, module, member, or block may include a plurality of components, depending on the embodiment of the disclosure.

It will be further understood that the term "connect" or its derivatives refer both to direct and indirect connection, and the indirect connection includes a connection over a wireless communication network.

The term "include (or including)" or "comprise (or comprising)" is inclusive or open-ended and does not exclude additional, unrecited elements or method steps, unless otherwise mentioned.

Throughout the specification, when it is said that a member is located "on" another member, it implies not only that the member is located adjacent to the other member but also that a third member exists between the two members.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section.

It is to be understood that the singular forms "a," "an," and "the" include plural references unless the context clearly dictates otherwise.

Reference numerals used for method steps are just used for convenience of explanation, but not to limit an order of the steps. Thus, unless the context clearly dictates otherwise, the written order may be practiced otherwise.

Reference will now be made in detail to embodiments of the disclosure, which are illustrated in the accompanying drawings. A dryer 1 according to the disclosure may be used to dry and/or manage clothing, shoes, miscellaneous items, etc.

An aspect of the disclosure provides a dryer capable of efficiently dehumidifying air outside the dryer in addition to having a function of drying an object to be dried.

According to the disclosure, a dryer has a function of dehumidifying outside air in addition to a function of drying an object to be dried, thereby eliminating the need to install an extra dehumidifier in a space with the dryer.

Figure 2:
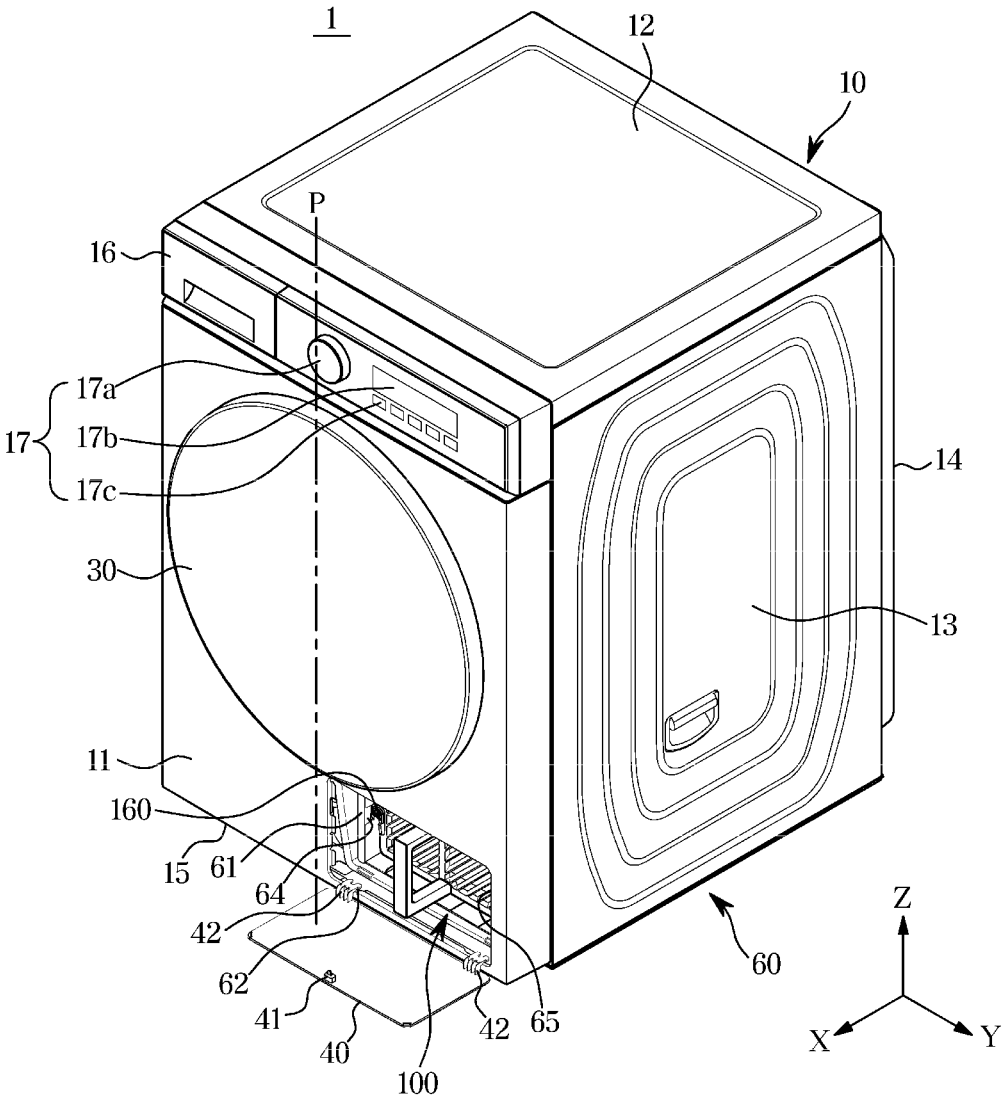
FIG. 2 illustrates a dryer having a dehumidification unit installed therein, according to an embodiment.
Figure 3:
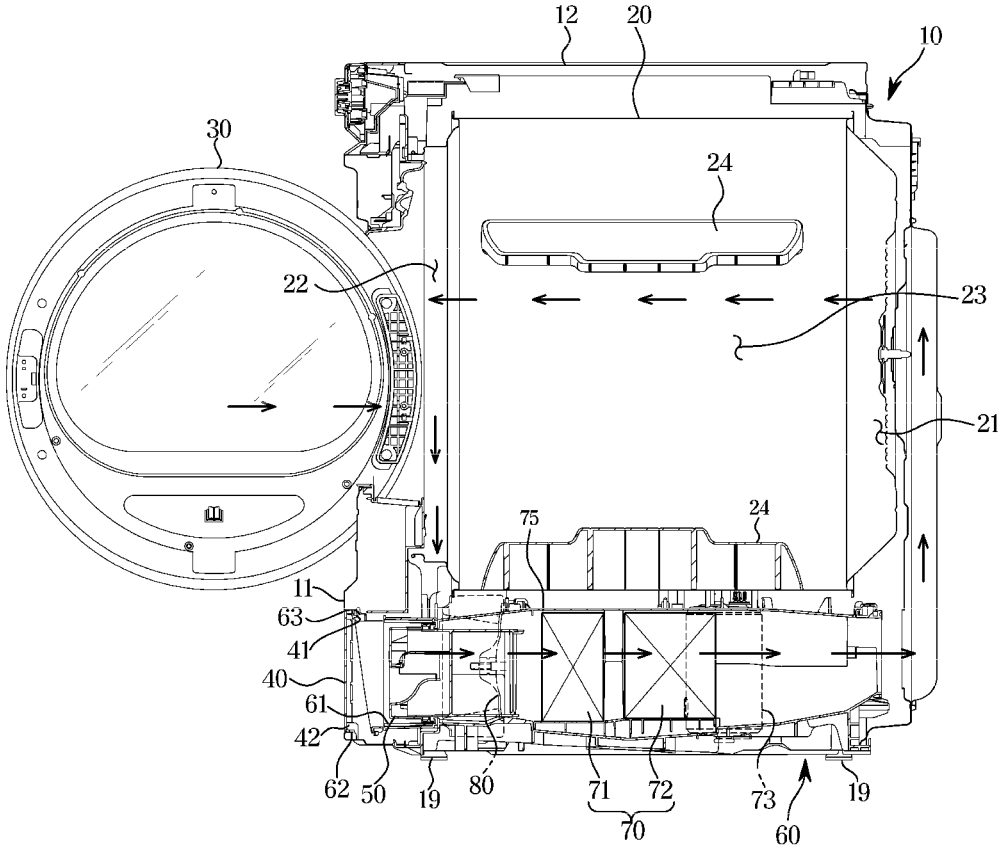
FIG. 3 is a side cross-sectional view of a dryer, according to an embodiment.
Figure 4:
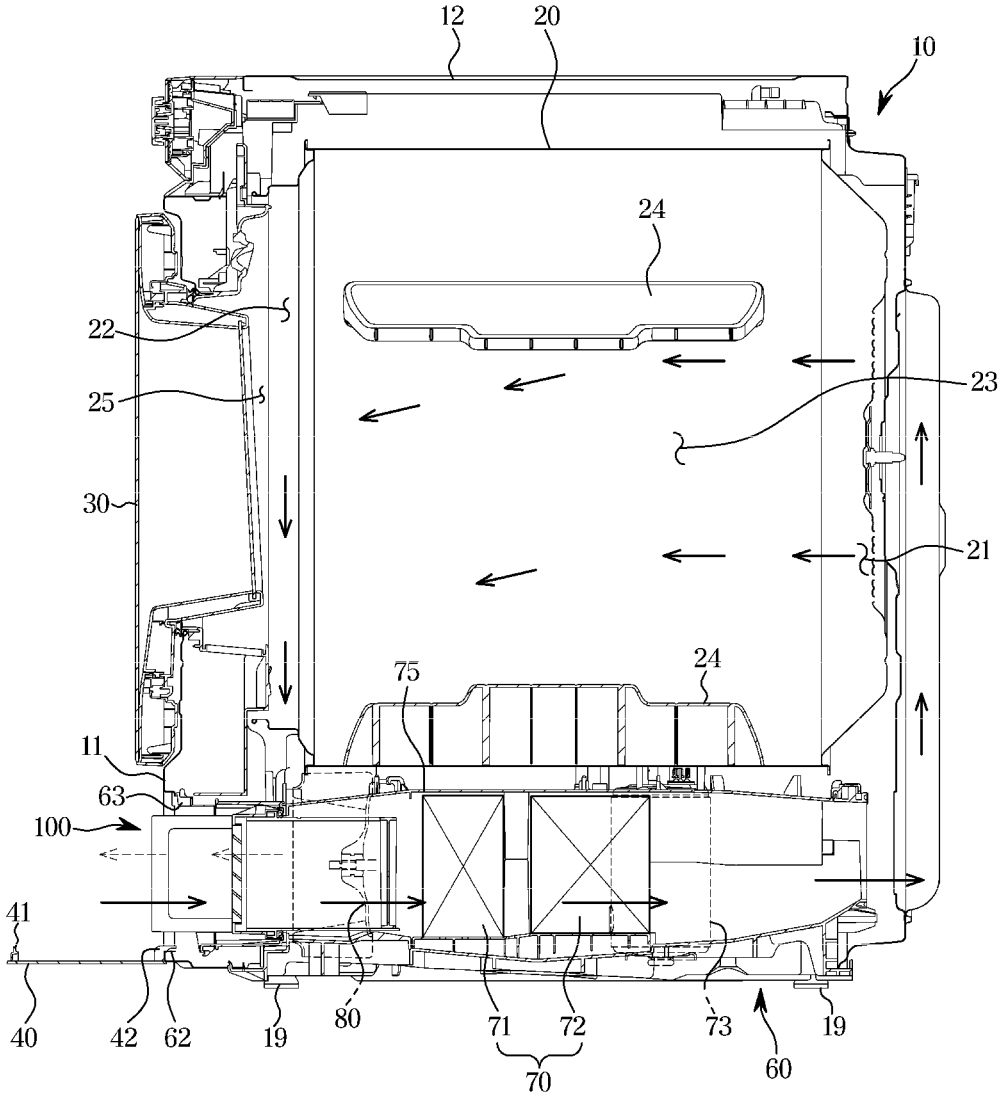
FIG. 4 is a side cross-sectional view of a dryer having a dehumidification unit installed therein, according to an embodiment.

Furthermore, according to the disclosure, a dryer may have improved dehumidification performance by detecting a proper condition in which to perform a dehumidification function. FIG. 1 is an exterior view of a dryer, according to an embodiment, FIG. 2 illustrates a dryer having a dehumidification unit installed therein, according to an embodiment, FIG. 3 is a side cross-sectional view of a dryer, according to an embodiment, and FIG. 4 is a side cross-sectional view of a dryer having a dehumidification unit installed therein, according to an embodiment.

Referring to FIG. 1, a direction along the X-axis may be defined as a front-back direction, a direction along the Y-axis may be defined as a left-right direction, and a direction along the Z-axis may be defined as an up-down direction The terms "front-back direction", "left-right direction", "up-down direction", etc., as herein used are defined with respect to the drawings, but the terms may not restrict the shapes and positions of the respective components.

Referring to FIG. 1, a dryer 1 according to an embodiment of the disclosure may include a main body 10. The main body 10 may include a front plate 11, a top plate 12, side plates 13, a rear plate 14, and a bottom plate 15, which may form into an almost rectangular shape. The may body 10 may constitute a main frame of the dryer 1.

A condensation water storage 16 may be arranged in the main body 10, and may be. Specifically, the condensation water storage 16 may be arranged in an upper portion on the front plate 11 of the main body 10. The condensation water storage 16 may store condensate water produced from the operation of a refrigerant cycle, which will be described later.

There may be an input device 17 provided on the main body 10 to operate the dryer. Specifically, the input device 17 may be arranged on an upper portion of the front plate 11 of the main body 10. The input device 17 may include at least one of a dial switch 17*a*, a display device 17*b*, and buttons 17*c*. The dial switch 17*a* may be arranged for the user to select a mode of the dryer 1 by grasping and turning the tunable switch 17*a*. The display device 17*b* may be arranged to display operation information including an operation state and/or a user manipulation state of the dryer 1. The display device 17*b* may have a display structure of a capacitive touch type, and may be arranged to allow the user to make touch inputs for various commands. The buttons 17*c* may be arranged for the user to select a mode of the dryer 1 by pressing them. It is not, however, limited thereto, and there may be various manipulation methods.

The display device 17*b* may display information about whether a dehumidification mode is available in addition to the aforementioned operation information. For example, the display device 17*b* may be controlled to display information about a door open or closed state based on a received door open or close signal 410 (see FIG. 10). Furthermore, the display device 17*b* may be controlled to display information about an installation state of the dehumidification unit 100 based on an installation signal received from a unit sensor 420. In addition, the display device 17*b* may be controlled to display information about a positional state of a fluid path guide 230 based on a position detection signal received from a fluid path position detection sensor 430 while the dehumidification unit 100 is installed. In conclusion, the display device 17*b* may notify the user of whether an open fluid path has been formed, i.e., whether the dehumidification mode is available.

The main body 10 may include a base 60. The base 60 may be arranged at the bottom of the main body 10, forming the bottom plate 15. There may be legs 19 provided at the bottom plate 10 to support the main body 10.

The dryer 1 may include a drum 20 arranged to receive an object to be dried (also referred to simply as an object). The drum 20 may include an entrance of the drum, through which to throw in the object. The drum 20 may be rotationally arranged in the main body 10.

Figure 5:
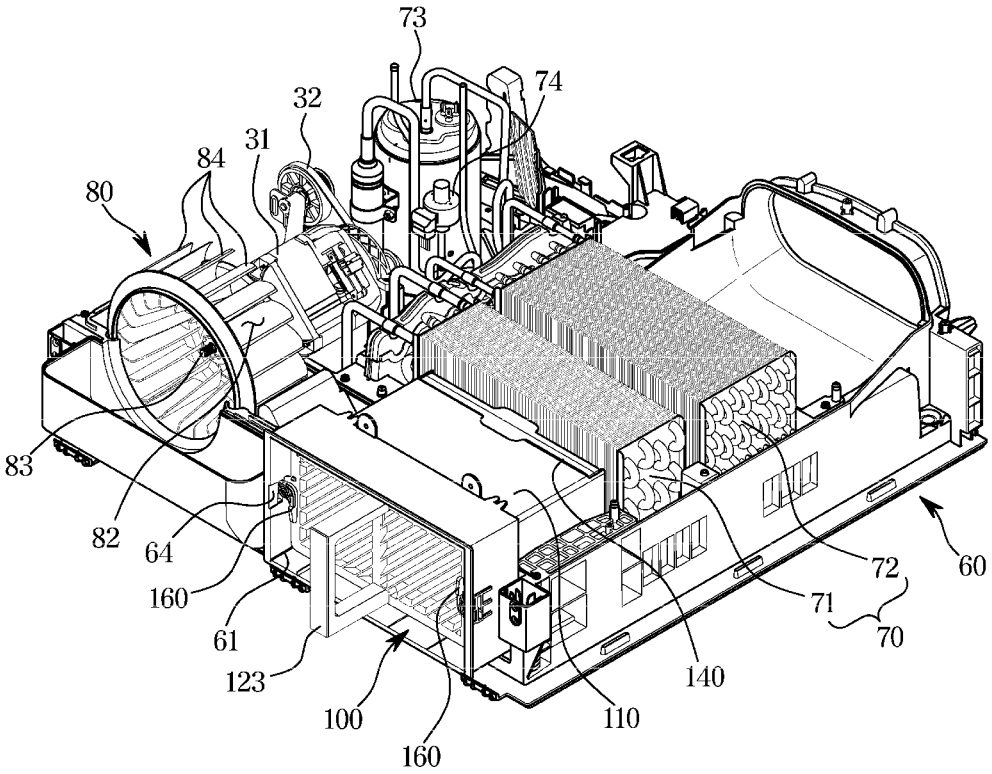
FIG. 5 illustrates a base of a dyer, according to an embodiment.

The dryer 1 may include a driver to rotate the drum 20. Referring to FIG. 5, the driver may include a driving motor 31 settled on the base 60, a pulley 32 rotated by the driving motor 31, and a belt (not shown) that connects the pulley 32 to the drum 20 for transferring power of the driving motor 31 to the drum 20.

In the meantime, in an embodiment, the dryer 1 may suck in humid outside air while the door 30 is open, and dehumidify outside space by discharging the air dried through a refrigerant cycle of a heat exchanger 70. In this case, as the door 30 of the dryer 1 is open, an open fluid path may be formed. Furthermore, in an embodiment, the dryer 1 may further include the dehumidification unit 100 that may form the open fluid path even while the door 30 is closed. The dryer 1 further including the dehumidification unit 100 will be described with reference to FIGS. 2 to 4.

FIG. 2 illustrates a dryer having a dehumidification unit installed therein, according to an embodiment. Referring to FIG. 5, the dehumidification unit 100 may be detachably installed in the dryer 1. The dehumidification unit 100 may be installed into the main body 10 through a second opening 65 arranged on the front plate of the main body 10. Furthermore, instead of a filter unit 50, the dehumidification unit 100 may be installed in the dryer 1. That is, the dehumidification unit 100 and the filter unit 50 may be provided to replace each other. In other words, the user may install the dehumidification unit 100 or the filter unit 50 into the dryer 1 according to an intended function (dehumidification mode or dry mode). For example, when the filter unit 50 is removed from the main body 10, the dehumidification unit 100 may be detachably installed into a unit receiver 61. The dehumidification unit 100 may be detachably mounted on the base 60.

In the disclosure, the dryer 1 is equipped with a fan 80 that forms a fluid path by sucking in humid outside air, forcing the air to pass through the heat exchanger 70 and the drum 20 and then discharging dry air to the outside of the dryer. The dryer 1 may have the fluid path differently formed depending on whether the dehumidification unit 100 is installed or not. This will be described in detail with reference to FIGS. 3 and 4.

FIG. 3 is a side cross-sectional view of a dryer, according to an embodiment.

Referring to FIG. 3, the drum 20 may include an inlet 21 through which air flows to the inside 23 of the drum, and an outlet 22 through which air flows out of the drum from the inside 23 of the drum. The inlet 21 may be formed on one side of the drum 20 and the outlet 22 may be formed on the other side of the drum 20. Specifically, the inlet 21 may be a rear opening of the drum 20, and the outlet 22 may be a front opening of the drum 20. For example, the front opening of the drum 20 may be an entrance of the drum.

Hot and dry air may flow into the drum 20 through the inlet 21, and dry the object contained in the drum 20. Furthermore, the air that has gotten to contain lots of water after the drying of the object may get out of the drum 20 through the outlet 22.

A plurality of lifters 24 may be arranged inside the drum 20. The lifters 24 may lift and drop the object so that the object contacts hot air while the object drifts in the space in the drum 20.

To throw the object into the drum 20, a first opening (or inlet) 25 may be formed on the front of the main body 10, and a door 30 may be installed to open or close the first opening 25. The door 30 may be hinged to one side of the first opening 25 to pivot from the one side.

The base 60 may be arranged at the bottom of the drum 20. Referring to FIG. 5, the heat exchanger 70, a compressor 73, an expansion device 74, etc., which constitute the refrigerant cycle, may be settled on the base 60. The fan 80, the driving motor 31, the pulley 32, etc., may also be settled on the base 60. A base cover 75 may be arranged above the base 60 to cover the heat exchanger 70 and so on. For example, the base cover 75 may form a duct structure with the base 60.

The fan 80 may be arranged on the base 60. The fan 80 may form an air fluid path by generating wind power. For example, the fan 80 may discharge air in a radial direction. For this, the fan 80 may include a rotation shaft 83 formed at the center, and a plurality of blades 84 formed in a circumferential direction centered at the rotation shaft 83.

In the embodiment, the dryer 1 may form an open fluid path while the door 30 is open. In this case, when the dehumidification mode is performed, the dryer 1 forces humid outside air to flow in through the front opening of the drum 20 and the air dried after passing through the heat exchanger 70 and the drum 20 to flow out through the front opening. In this case, there is no need for the door 30 to be fully opened, and it is sufficient for the door 30 to be not fully closed but opened to such an extent that allows the air to be moved through part of the front opening.

In the embodiment, in the dryer 1, when the fan 80 is operated, the open fluid path is formed to allow the air to be moved in a direction from the front opening->heat exchanger 70->the flow-in port 21->the drum 20->the front opening. The humid outside air may become dry air through the fluid path formed and may be discharged into space where the dryer 1 is installed.

A refrigerant cycle may be formed in the main body 10 to heat and condense the air. Refrigerant may circulate in a series of processes including compression, condensation, expansion, and evaporation. Specifically, the refrigerant cycle may include the heat exchanger 70, the compressor 73, and the expansion device 74. The heat exchanger 70 may exchange heat with air and may include the evaporator 71 and the condenser 72.

The compressor 73 compresses the refrigerant into a high temperature and high pressure state and discharges the refrigerant, and the discharged refrigerant flows into the condenser 72. The condenser 72 may condense the compressed refrigerant and radiate heat around through a condensation process. Furthermore, the expansion device 74 expands the refrigerant in the high temperature and high pressure state, which is condensed by the condenser 72, into a low pressure state. The evaporator 71 may evaporate the expanded refrigerant, and take the surrounding heat during the evaporation process.

When the object is thrown into the dryer 1 and the dry mode is operated, the hot and humid air flowing out from the drum 20 may pass through the evaporator 71. Accordingly, the hot and humid air flowing out from the drum 20 may be cooled while passing through the evaporator 71 and may turn to dry air with low temperature. At this time, condensate water may be produced while the hot and humid air is cooled in the evaporator 71. The condensate water may be moved into the condensation water storage 16 or discharged out of the main body 10. Furthermore, the air that has become dry and cool after passing through the evaporator 71 may pass through the condenser 72. Accordingly, the dry and cool air discharged from the evaporator 71 may be heated while passing through the condenser 72 and may turn to hot and dry air. The hot and dry air may flow into the drum 20 through the inlet 21, and dry the object therein. Hot and humid air containing lots of water due to the drying of the object may flow out through the outlet 22. The air that has flown out may pass through the evaporator 71 again. To sum up, air circulates in the main body 10 to dry the object contained in the drum 20.

Normally, in the dry mode, a closed fluid path may be formed in the main body 10 of the dryer 1. The closed fluid path herein may be an air flowing path arranged for air in a cabinet to circulate through the heat exchanger 70 and the drum 20. The close fluid path may not be connected to the outside of the main body 10 to prevent the outside air from flowing in or out. That is, a flow of air may form a closed loop.

In the meantime, the dryer 1 may further include the dehumidification unit 100 to perform the dehumidification function not only while the door 30 is open but also while the door 30 is closed. When the dehumidification unit 100 is installed in the dryer 1, dehumidification may be performed through the open fluid path formed by the dehumidification unit 100.

Figure 6:
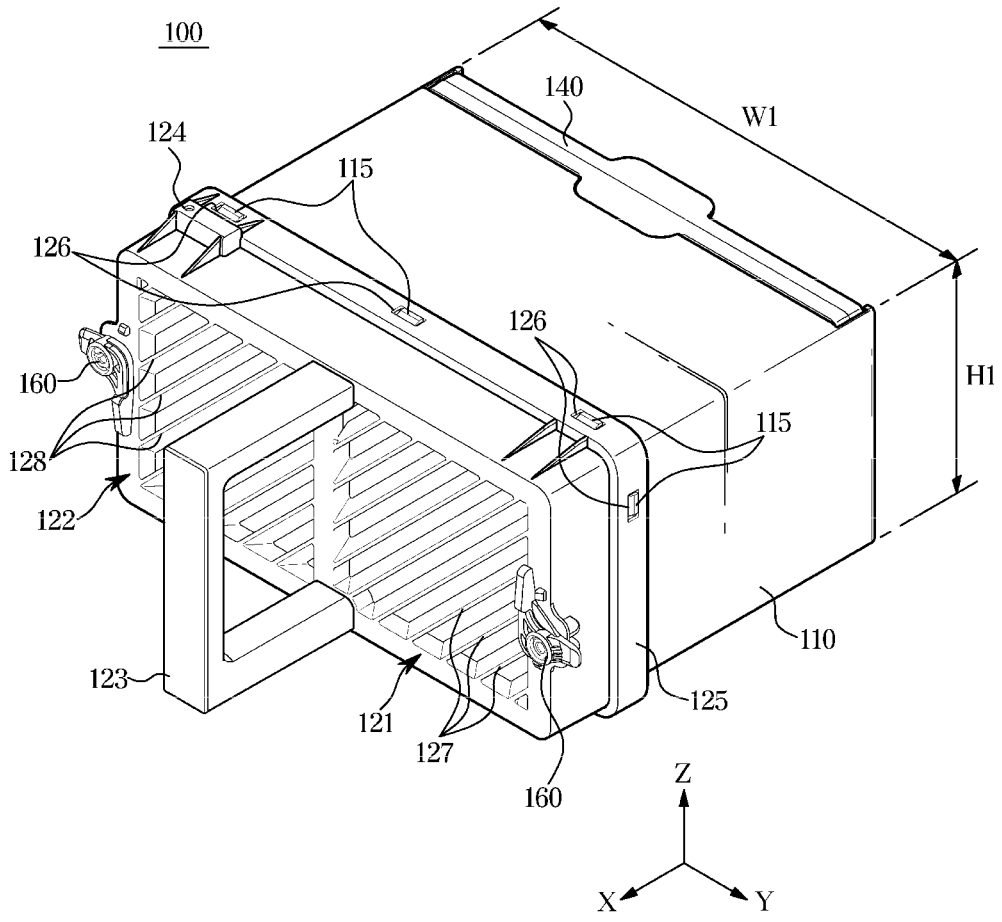
FIG. 6 illustrates a dehumidification unit.

FIG. 4 is a side cross-sectional view of a dryer having a dehumidification unit installed therein, according to an embodiment, FIG. 5 illustrates a base of a dyer, according to an embodiment, and FIG. 6 illustrates a dehumidification unit.

As shown in FIGS. 4 and 5, the dehumidification unit 100 may be arranged on the base 60. Specifically, the dehumidification unit 100 may be detachably mounted on the base 60.

Especially, as the dehumidification unit 100 is installed in the dryer 1, the dryer 1 may have the open fluid path even while the door 30 is completely closed. The open fluid path may be an air flowing path (see arrows of FIG. 4) formed for the outside air to be sucked into the dryer 1, passing through the heat exchanger 70 and the drum 20, and discharged out of the dryer 1. Alternatively, the open fluid path may be an air flowing path formed for the outside air to be sucked into the dryer 1, passing through the heat exchanger 70, and discharged out of the dryer 1. Both ends of the open fluid path (an inlet port 121 and an outlet port 122 as will be described later) are connected to the outside of the main body 10, forming an open loop of a flow of air.

When the filter unit 50 as shown in FIG. 3 is removed and the dehumidification unit 100 is mounted in the dryer 1, a closed fluid path may be switched to the open fluid path even while the door 30 is fully closed. Accordingly, the dryer 1 may perform a dehumidification operation (dehumidification mode). That is, the dryer 1 may be switched from the dry mode into the dehumidification mode.

The dehumidification unit 100 according to an embodiment of the disclosure will now be described in detail.

Referring to FIG. 6, the dehumidification unit 100 according to an embodiment of the disclosure may include a body 110. The body 110 may be provided in the form of substantially a box. The dehumidification unit 100 may include the inlet port 121 and the outlet port 122. The inlet port 121 and the outlet port 122 may be arranged on the front side of the body 110. The inlet port 121 may be arranged for air to flow in from the outside of the main body 10 through the second opening 65 (see FIG. 2). The outlet port 122 may be arranged for air to flow out of the main body 10 through the second opening 65. Specifically, humid outside air may be sucked into the dryer 1 through the inlet port 121, and hot and dry air may be discharged from the inside of the dryer 1 to the outside through the outlet port 122.

The outlet port 122 may be arranged next to the inlet port 121. Specifically, the inlet port 121 and the outlet port 122 may be arranged side by side in the left-right direction. The inlet port 121 and the outlet port 122 may be positioned on the same plane. In the disclosure, when the dryer 1 is viewed from the front, the outlet port 122 may be arranged on the left hand and the inlet port 121 may be arranged on the right hand. This arrangement is determined depending on which side the heat exchanger 70 is located with respect to the drum 20 of the dryer 1: when the heat exchanger 70 is arranged to the right of the drum 20 when the dryer 1 is viewed from the front, the outlet port 122 is arranged to be close to the drum 20 and the inlet port 121 is arranged to be far from the drum 20, so that the fluid path may be simplified. In other words, to make the air discharged from the drum 20 flow smoothly, it is advantageous to arrange the outlet port 122 to be close to the center of the dryer 1 and arrange the inlet port 121 to be close to a side of the dryer 1. For example, as shown in FIG. 2, as for a perpendicular line that passes the center of the first opening 25 (see FIG. 4), the outlet port 122 may be arranged to be closer to the perpendicular line than the inlet port 121 is.

In the disclosure, the dehumidification unit 100 has a rectangular shape with wide width W1 and low height H1, and it is efficient to divide the width W1 equally into the inlet port 121 and the outlet port 122. Specifically, an area occupied by the inlet port 121 and an area occupied by the outlet port 122 on the front side of the dehumidification unit 100 are equally formed, so that an air flow-in rate is equal to an air flow-out rate.

An outlet 111 (see FIG. 8) may be arranged on a first side of the body 110 of the dehumidification unit 100. For example, the outlet 111 may be formed on the rear side of the body 110. The outlet 111 may guide outside air brought in through the inlet port 121 to the heat exchanger 70. Specifically, the outlet 111 may be connected to the inlet port 121. The heat exchanger 70 may be arranged behind the outlet 111, which may be arranged to face the heat exchanger 70. The outside air brought in may be humid air before dehumidification.

An inlet 112 may be arranged on a second side of the body 110 of the dehumidification unit 100. For example, the inlet 112 may be formed on a side of the body 110. Although the inlet 112 is shown as being formed on the left side of the body 110, it is not limited thereto. For example, the inlet 112 may be formed on the right side of the body 110, by modifying the air fluid path, the base structure, etc. In the disclosure, in the structure in which the dehumidification unit 100 is arranged to the right of the drum 20, a smooth fluid path may be formed by arranging the inlet 112 to the left of the dehumidification unit 100. The inlet 112 may be connected to the outlet port 122 so that the air discharged from the drum 20 is discharged to the outside through the outlet port 122. The air discharged from the drum 20 may be dehumidified and heated while passing through the heat exchanger 70, which may be hot and dry air discharged through the drum 20. Specifically, when the dryer 1 according to the disclosure is operated in the dehumidification mode, it is normal for the inside of the drum 20 to be empty, so the hot and dry air brought into the back of the drum has actually no change in humidity while being discharged through the entrance of the drum 20.

The dehumidification unit 100 may further include at least one of a suction filter 140 and a discharge filter 150. Specifically, the suction filter 140 and the discharge filter 150 may be detachably installed into the body 110 of the dehumidification unit 100. The suction filter 140 may filter out foreign materials brought into the dehumidification unit 100 and foreign materials to be otherwise discharged out of the dryer 1.

The suction filter 140 may be arranged behind the inlet port 121. Specifically, it may be arranged at the outlet 111. The suction filter 140 may be detachably mounted in the body 110. There may be a filter rail 117 arranged in the body 110 to install the suction filter 140. The suction filter 140 may include a filter frame 141 and a filter 142 mounted on the filter frame 141. The suction filter 140 may filter out foreign materials in the air brought in from the outside of the main body 10 through the inlet port 121. Accordingly, the foreign materials may be prevented from coming into the heat exchanger 70 when the outside air is brought in. For example, the filter 142 may include at least one of woolen stuff (fabric), PET, and a steel substance.

The discharge filter 150 may be arranged behind the outlet port 122. Specifically, it may be arranged in a discharge fluid path 180, as will be described later. The discharge filter 150 may be detachably mounted in the body 110. There may be a filter rail 118 arranged in the body 110 to install the discharge filter 150. The discharge filter 150 may include a filter frame 151 and a filter 152 mounted on the filter frame 151. The discharge filter 150 may filter out foreign materials in the air contained in the body 110 through the inlet 112. Accordingly, the foreign materials may be prevented from being discharged to the outside when the air is discharged to the outside. For example, the filter 152 may include at least one of woolen stuff (fabric), PET, and a steel substance.

Figure 7:
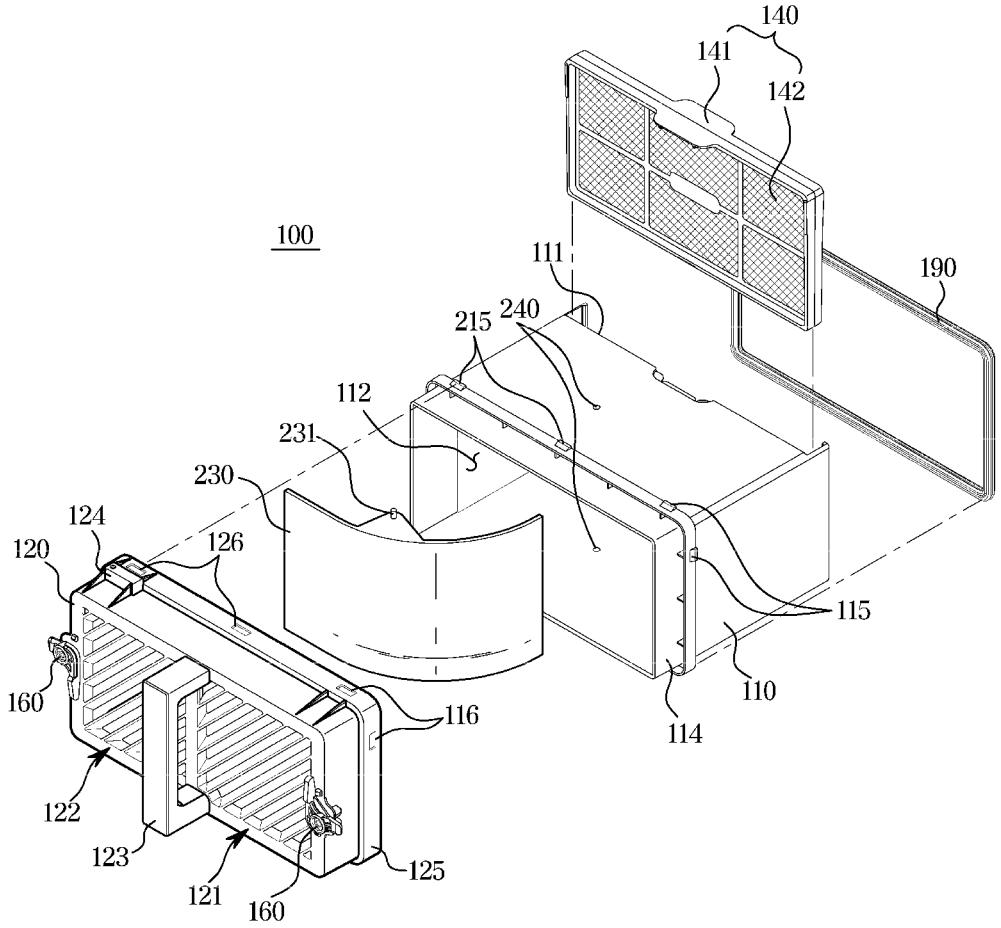
FIG. 7 is an exploded view of a dehumidification unit.
Figure 8:
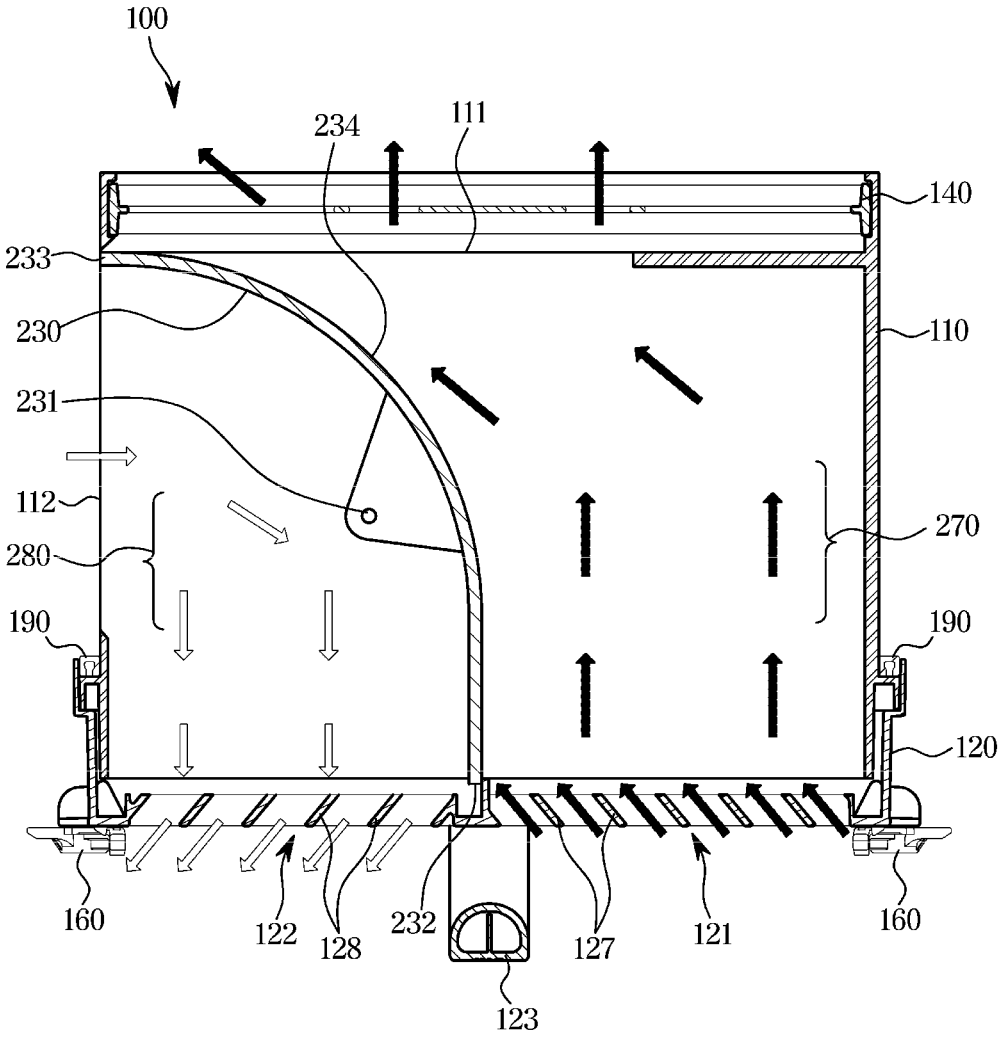
FIG. 8 is a plan view of a dehumidification unit with a guide located in a first position.
Figure 9:
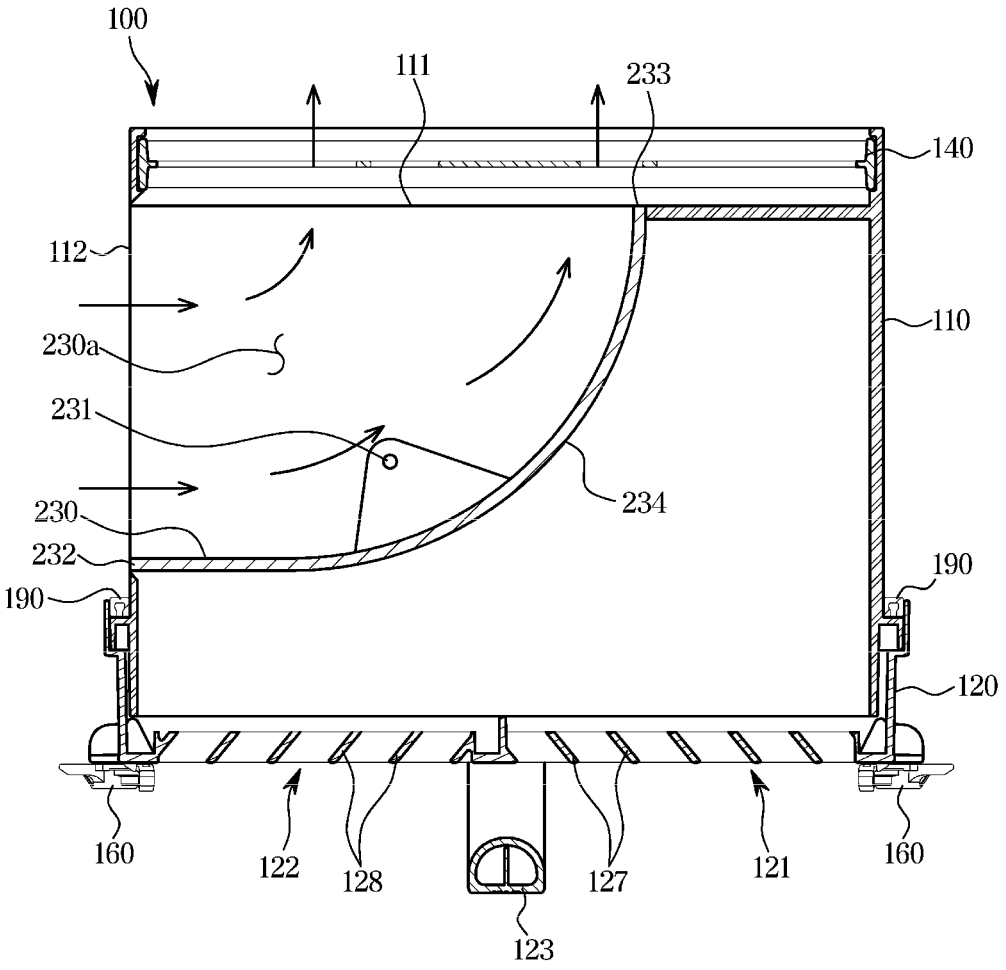
FIG. 9 is a plan view of a dehumidification unit with a guide located in a second position.

Referring to FIGS. 7 to 9, the principles of the dehumidification unit 100 switching the closed fluid path to the open fluid path or the open fluid path to the closed fluid path are further described.

FIG. 7 is an exploded view of a dehumidification unit, FIG. 8 is a plan view of a dehumidification unit with a guide located in a first position, and FIG. 9 is a plan view of a dehumidification unit with a guide located in a second position.

The dehumidification unit 100 may include the body 110. The body 110 may include a body installation part 114 and an installation projection 115 to be coupled with a front cover 120. The installation projection 115 may be settled in an installation hole 116 as the body installation part 114 is coupled with the cover installation part 125.

The front cover 120 may be coupled onto the front of the body 110. The suction filter 140 may be arranged behind the body 110. There may be a sealing member 190 arranged between the body 110 and the front cover 120.

In the meantime, in the disclosure, the dehumidification unit 100 has a rectangular shape with wide width W2 and low height H2, and it is efficient to divide the width W2 equally into the inlet port 121 and the outlet port 122. Specifically, an area occupied by the inlet port 121 and an area occupied by the outlet port 122 on the front side of the dehumidification unit 200 are equally formed, so that an air flow-in rate is equal to an air flow-out rate.

The outlet 111 may be arranged on the first side of the body 110 of the dehumidification unit 100. For example, the outlet 111 may be formed on the rear side of the body 110. The outlet 111 may guide outside air brought into the body 110 through the inlet port 121 to the heat exchanger 70. Specifically, the outlet 111 may be connected to the inlet port 121. The heat exchanger 70 may be arranged behind the outlet 111, which may be arranged to face the heat exchanger 70. The outside air brought in may be humid air before dehumidification.

The inlet 112 may be arranged on the second side of the body 110 of the dehumidification unit 100. For example, the inlet 112 may be formed on a side of the body 110. Although the inlet 112 is shown as being formed on the left side of the body 110 in FIG. 7, it is not limited thereto and may be formed on the right side. The inlet 112 may receive the air that has passed through the heat exchanger 70. The inlet 112 may be connected to the outlet port 122 so that the air that has passed through the heat exchanger 70 is discharged to the outside through the outlet port 122. The air that has passed through the heat exchanger 70 may be hot and dry air resulting from exchanging heat with the heat exchanger 70 and dehumidification.

The dehumidification unit 100 may include a fluid path guide 230 provided to be rotatable in the body 110.

The fluid path guide 230 may include a rotation shaft 231 rotationally coupled to the body 110, and the body 110 may include coupling holes 240 to be matched to the rotation shaft 231. The fluid path guide 230 may be rotated to a certain extent while the rotation shaft 231 is put into the coupling holes 240. It is not, however, limited thereto, and in a reverse configuration, the body 110 may include the rotation shaft and the fluid path guide 230 may include coupling holes.

As shown in FIG. 8, the fluid path guide 230 may be in the first position P1 to separate an inlet fluid path 270 from an outlet fluid path 280. The fluid path guide 230 may form the inlet fluid path 270 by connecting the outlet 111 to the inlet port 121. The fluid path guide 230 may form the outlet fluid path 280 partitioned off from the inlet fluid path 270 by connecting the inlet 112 to the outlet port 122.

The inlet fluid path 270 may extend from the inlet port 121 to the outlet 111. In other words, the inlet fluid path 270 may be a passage through which the outlet 111 is connected to the inlet port 121. The air brought into the body 110 through the inlet port 121 may pass along the inlet fluid path 270 and through the outlet 111 and may be supplied to the heat exchanger 70. In other words, the air before dehumidification may be delivered to the heat exchanger 70 along the inlet fluid path 270.

The outlet fluid path 280 may extend from the inlet 112 to the outlet port 122. In other words, the outlet fluid path 280 may be a passage through which the inlet 112 is connected to the outlet port 122. The air brought into the body 110 through the inlet 112 may pass along the outlet fluid path 280 and through the outlet port 122 and may be moved to the outside of the main body 10. In other words, the air after dehumidification, which is dried by passing through the heat exchanger 70, may be discharged out of the main body 10 along the outlet fluid path 280.

Furthermore, as shown in FIG. 9, the fluid path guide 230 may be located in a second position P2 that creates a fluid path 230*a* by connecting the outlet 111 to the inlet 112. Moreover, while in the second position P2, the fluid path guide 230 may block the connection between the outlet 111 and the inlet port 121 and the connection between the inlet 112 and the outlet port 122. The fluid path 230*a* may be a portion of the close fluid path, which may perform the same function as a fluid path 50*a* formed in the filter unit 50.

The fluid path guide 230 may be arranged to be movable between the first position P1 and the second position P2. Furthermore, the fluid path guide 230 may be rotationally arranged. Specifically, the fluid path guide 230 may be switched into the second position P2 by being rotated from the first position P1. Furthermore, the fluid path guide 230 may be switched into the first position P1 by being rotated from the second position P2.

For example, when the fluid path guide 230 is located in the first position P1, the open fluid path may be formed in the dryer 1. In this case, both ends of the open fluid path (i.e., the inlet port 121 and the outlet port 122) may be connected to the outside. For example, when the fluid path guide 230 is located in the first position P1, the dryer 1 may perform the dehumidification operation (dehumidification mode). When the fluid path guide 230 is located in the second position P2, the closed fluid path may be formed in the dryer 2. For example, when the fluid path guide 230 is located in the second position P2, the dryer 1 may perform the drying operation (dry mode). To sum up, the dehumidification unit 100 may have a different operation mode (the dry mode or the dehumidification mode) depending on the rotation of the fluid path guide 230. Accordingly, it is easy for the dryer 1 to be switched between the dry mode for drying the object and the dehumidification mode for indoor dehumidification.

In the meantime, the fluid path guide 230 may include a curved portion 234. The fluid path guide 230 may be curved to a certain extent to smoothly form the inlet fluid path 270 and the outlet fluid path 280. For example, as shown in FIG. 8, when the fluid path guide 230 is located in the first position P1, the fluid path guide 230 may serve to form a curved section in the outlet fluid path 280. Furthermore, the fluid path guide 230 may be curved toward the back of the body 110 to expand the inlet fluid path 270. However, it is not limited thereto. As the fluid path guide 230 includes the curved portion 234, the air may smoothly flow in or out.

In the meantime, the fluid path guide 230 may be automatically rotated. The dehumidification unit 100 includes a fluid path position detection sensor 430 (see FIG. 10) and a fluid path position switching device (not shown). A controller 400 may control the fan 80 based on a position detection signal received from the fluid path position detection sensor 430. For example, the position switching device may be a rotation motor. Furthermore, the controller 400 may form the open fluid path by moving the fluid path guide 230 to the first position P1 from the second position P2 based on the position detection signal before controlling the fan 80. For example, the fluid path guide 230 may receive rotation power when connected to the rotation motor.

Specifically, the fluid path guide 230 may automatically switch the fluid path formed in the dryer 1 from the closed fluid path to the open fluid path. In other words, as the fluid path guide 230 is moved from the second position P2 to the first position P1, the dryer 1 may be switched from the dry mode to the dehumidification mode. Furthermore, the fluid path guide 230 may switch the fluid path formed in the dryer 1 from the open fluid path to the closed fluid path. The dehumidification unit 100 may form the open fluid path by providing a first fluid path that guides the air brought in from the outside of the main body 10 to the heat exchanger 70. Furthermore, the dehumidification unit 100 may form the closed fluid path by providing a second fluid path that guides the air discharged from the drum 20 to the heat exchanger 70. The fluid path guide 230 may be located in the first position P1 for the dehumidification unit 100 to provide the first fluid path or in the second position P2 to provide the second fluid path. For example, as the fluid path guide 230 is moved from the first position P1 to the second position P2, the dryer 1 may be switched from the dehumidification mode into the dry mode. In other words, as the fluid path guide 230 is automatically rotated, the user may easily select the dry mode or the dehumidification mode.

Accordingly, even when the dehumidification unit 100 is installed in the dryer 1, the dry mode may be performed when the fluid path guide 230 is located in the second position P2. In other words, to perform the dry mode, there is no need to remove the dehumidification unit 100 from the dryer 1 and then install the filter unit 50 back into the dryer 1. In other words, the trouble of installing and/or attaching an extra part (e.g., the filter unit 50) is relieved. As a result, according to the disclosure, the dryer 1 may automatically switch the fluid path, allowing the user to freely select the dry mode or the dehumidification mode.

Figure 10:
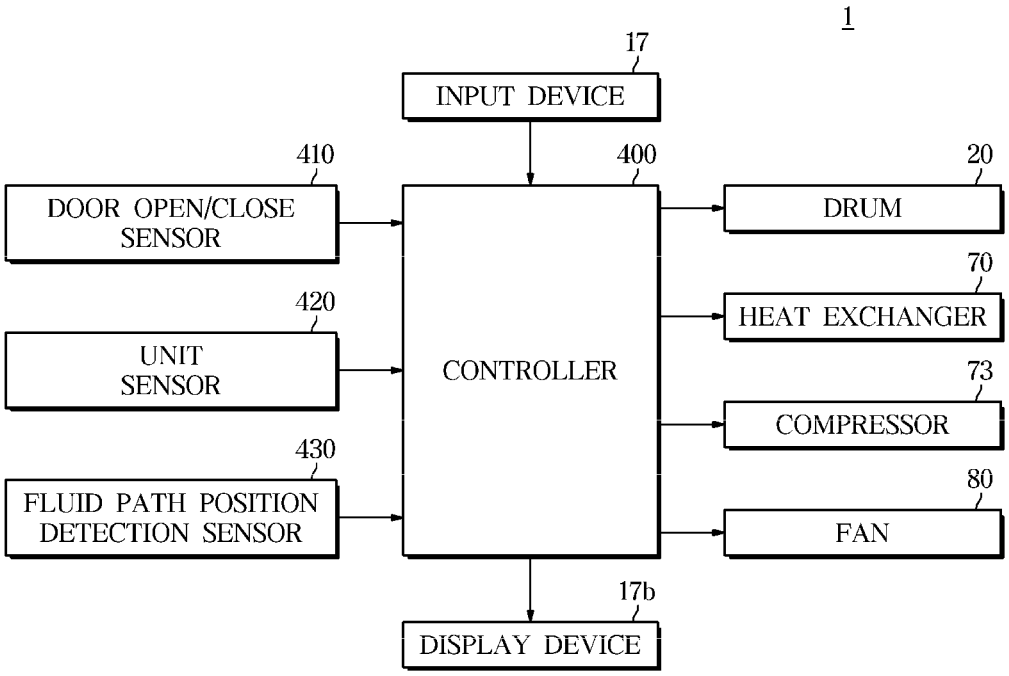
FIG. 10 is a control block diagram of a dryer, according to an embodiment.

FIG. 10 is a control block diagram of a dryer, according to an embodiment.

In an embodiment, the dryer 1 uses detection signals from the input device 17, the door open/close sensor 410, the unit sensor 420, and the fluid path position detection sensor 430 before performing the dehumidification mode.

The input device 17 allows the user to select a mode through rotation of a dial, a button input, or a display touch input. In the embodiment, the input device 17 may provide an interface to select the dry mode or the dehumidification mode. Upon receiving a selection of the dry mode or the dehumidification mode from the user, the input device 17 sends a corresponding control signal to the controller 400.

The door open/close sensor 410 includes a switch (not shown) including at least one contact to pass or block an electric signal. For example, the switch may be a lead switch or a micro switch, but it is not limited thereto as long as it is able to pass or block an electric signal such as pulse waves. The contact of the switch may be in an open state when the door 30 is opened, and in a short-circuited state, i.e., a conductive state when the door 30 is closed. As a result, the controller 400 may determine whether the door 30 is open or closed based on the state of the contact, and may determine that the door 30 is open, which is a state sufficient to perform the dehumidification mode. The door open/close sensor 410 may be arranged in any position in the main body 10 as long as the position may come into contact with a portion of the door 30.

The unit sensor 420 may detect installation of the filter unit 50 or installation of the dehumidification unit 100. There may be different identification means for the filter unit 50 and the dehumidification unit 100, which may be located in different positions. For example, a first identifier (not shown) for detecting installation of the filter unit 50 may be arranged on an upper right side of the front cover 52, and a second identifier (not shown) for detecting installation of the dehumidification unit 100 may be arranged on an upper left side of the front cover 120. Accordingly, the dryer 1 may easily identify whether the filter unit 50 is installed and/or whether the dehumidification unit 100 is installed based on the position of detection.

The fluid path position detection sensor 430 may detect a position of the fluid path guide 230. Specifically, the fluid path position detection sensor 430 may distinguish between an occasion when the fluid path guide 230 is in the first position P1 and an occasion when the fluid path guide 230 is in the second position P2. For example, the fluid path position detection sensor 430 may distinguish between an occasion when the fluid path guide 230 is in the first position P1 and an occasion when the fluid path guide 230 is in the second position P2 by detecting positions of both side ends 232 and 233 of the fluid path guide 230 (see FIG. 8 or 9) of the fluid path guide 230. Accordingly, the controller 400 may determine whether the fluid path in the dryer 1 is the open fluid path or the closed fluid path when the dehumidification unit 100 is installed. As a result, the controller 400 may determine through the guide sensor 230 whether the dryer 1 may be in a proper state in which to perform the dehumidification mode.

The display device 17*b* displays an operation state and/or a user manipulation state of the dryer 1.

The controller 400 may include a memory (not shown) for storing a program and data for controlling operation of the dryer 1, and a processor (not shown) for generating control signals to control the operation of the dryer 1 according to the program and data stored in the memory.

Upon receiving a command for the dehumidification mode through the input device 17, the controller 400 determines whether outside air is allowed to flow in through a fluid path formed by the fan 80. For example, the controller 400 may determine through the door open/close sensor 410 that the door 30 is open, and may generate a control signal to form the open fluid path to perform the dehumidification mode. Furthermore, when the dehumidification unit 100 is installed in the dryer 1 and the door 30 is closed, the controller 400 may determine through the fluid path position detection sensor 430 whether the dehumidification unit 100 has formed the open fluid path. In this case, the controller 400 may generate a control signal to perform the dehumidification mode.

When the controller 400 determines that the open fluid path is formed in the dryer 1 and that it is possible to perform the dehumidification mode, the controller 400 may control the drum 20, the heat exchanger 70 and/or the fan 80 to be operated.

When the dehumidification mode is performed, the controller 400 controls the drum 20 to be rotated by providing a current to the driving motor 31 (see FIG. 5). As the drum is rotated, the temperature in the drum 20 rises, thereby enhancing dehumidification effects.

The fan 80 may share the driving power of the motor 31 supplied to the drum 20, and may be rotated along with the rotation of the drum 20. Alternatively, by adding a device such as an extra clutch (not shown) onto the base 60 or arranging the motor 31 in the plural, the fan 80 may be arranged to be separately rotated from the drum 20.

When the dehumidification mode is performed, the controller 400 may dehumidify humid outside air through the refrigerant cycle of the heat exchanger 70. In this case, the controller 400 may control a rate of the compressor 73 (see FIG. 5) to control the temperature in the drum 20.

When the dehumidification mode is performed, the controller 400 may control the compressor 73 such that that the temperature in the drum 20 has a lower value than in the dry mode. For example, the compressor 73 may be controlled such that the temperature in the drum 20 reaches 60 degrees in the dry mode and 40 degrees in the dehumidification mode. The controller 400 may control the temperature in the drum 20 to be maintained at a relatively low value, so that the temperature outside the dryer 1 does not deviate from the room temperature if possible. Such a temperature is merely an example, and may be set to various values depending on the external environment (temperature or humidity) of the dryer 1.

Furthermore, when the dehumidification mode is performed, the controller 400 may control the motor 31 such that the rotation speed of the fan 80 has a lower value than in the dry mode. For example, the magnitude of a current applied to the motor 31 may be controlled such that the rotation speed of the motor 31 reaches first rotation speed in the dry mode and second rotation speed in the dehumidification mode. As described above, as the drum 20 shares the driving power from the motor 31, a driving source for the fan 80, with the fan 80, the rotation speed of the drum 20 may depend on the rotation speed of the fan 80.

The controller 400 may control the rotation speed of each of the drum 20 and the fan 80 to have a lower value than in the dry mode, thereby preventing the outside temperature from deviating from the room temperature. Specifically, as the rotation speed of the drum 20 increases, the temperature in the drum 20 rises and the air discharged out of the dryer 1 may have a higher temperature value than the room temperature. Furthermore, as the rotation speed of the fan 80 increases, the volume of air discharged through the fluid path increases, thus causing a rise in temperature outside the dryer 1.

Accordingly, when the dehumidification mode is performed, the controller 400 controls the motor 31 such that the rotation speed of the motor 31 has a lower value than in the dry mode. Such a condition is merely an example, and may be set to have various values depending on the external environment (temperature or humidity) of the dryer 1.

Figure 11:
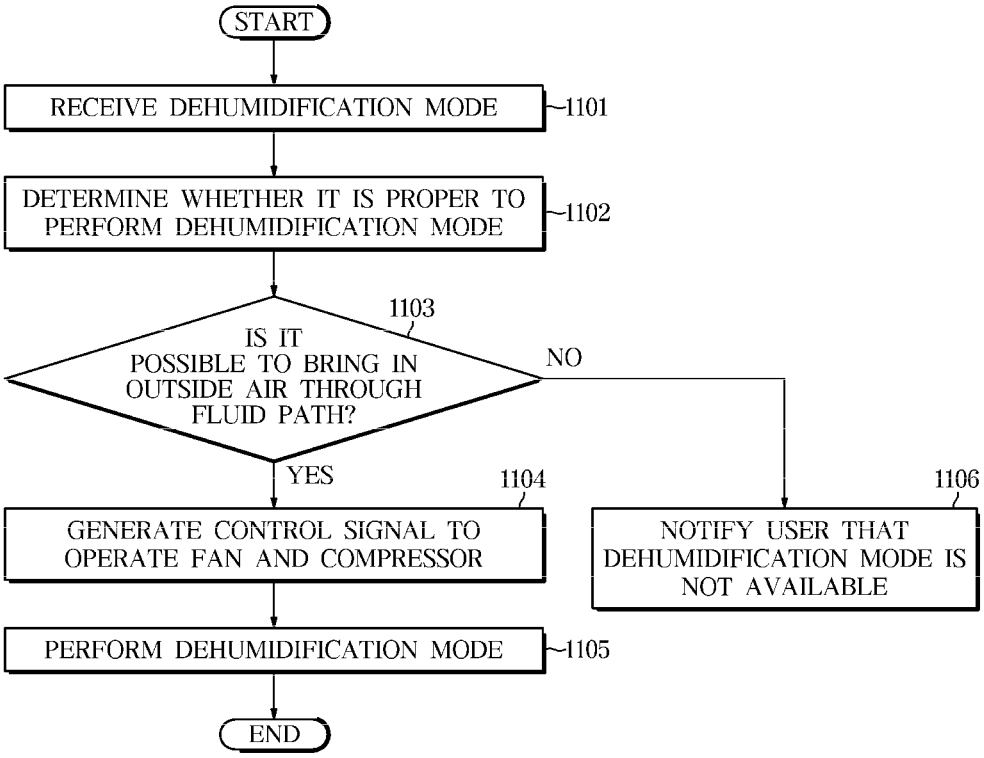
FIG. 11 is a flowchart of a method for controlling a dryer, according to an embodiment.

FIG. 11 is a flowchart of a method for controlling a dryer, according to an embodiment.

The controller 400 receives a dehumidification mode, in 1101. The input device 17 receives an input from the user to perform the dehumidification mode and sends a control signal for the dehumidification mode to the controller 400. In this case, the controller 400 does not perform the dehumidification mode as soon as it receives the control signal, but performs the dehumidification mode after a series of determination processes.

The controller 400 determines whether it is proper to perform the dehumidification mode, in 1102. In this case, a proper condition to perform the dehumidification mode is when the open fluid path is formed in the dryer 1 instead of the closed fluid path to allow the outside air to pass through the dryer 1 and move back to the outside. The open fluid path formed includes the open fluid path formed when the door 30 is open and the open fluid path formed according to a position of the fluid path guide 230 of the dehumidification unit 100. Whether the open fluid path is formed will be described in more detail by describing FIGS. 12 and 13.

When determining that it is possible to bring in outside air through the fluid path in 1103, the controller 400 generates a control signal to operate the fan 80 and the compressor 73 to perform the dehumidification mode in 1104, and sends the control signal to the fan 80 and the compressor 73 to perform the dehumidification mode in 1105. In response to the reception of a signal to operate the dehumidification mode from the input device 17 when the input device 17 receives a selection to perform the dehumidification mode from the user, the controller 400 controls the fan 80 to bring in air from outside the main body 10. In this case, the open fluid path that allows the air to flow in from the outside has been formed in the dryer 1, and the open fluid path may be formed by opening the door 30 or according to a position of the fluid path guide 230 of the dehumidification unit 100.

When the controller 400 determines that it is not possible to bring in outside air through the fluid path in 1103, the controller 400 may generate a notification signal to notify the user that the dehumidification mode is not available in 1106. Specifically, the controller 400 generates the notification signal, outputs an alert sound through a speaker (not shown), and notifies the user that the dehumidification mode has not been performed. Furthermore, the controller 400 generates the notification signal, and notifies the user that the dehumidification mode has not been performed by displaying a warning on the display device 17*b*.

Although not shown in FIG. 11, the controller 400 may control the dryer 1 not to perform the dehumidification mode when there is an object to be dried in the drum 20. The dryer 1 includes a motor to deliver power to rotate the drum 20, and the controller 400 controls the motor to rotate the drum 20 in response to an operation signal received from the input device 17. In this case, the dryer 1 may include a motor current sensor (not shown) that outputs a motor current signal corresponding to a current applied to the motor. The controller 400 may control the motor to stop rotation of the drum 20 based on the motor current signal received from the motor current sensor. In other words, the controller 400 does not generate a control signal to drive the fan 80 while the drum 20 contains an object to be dried. When there is the object in the drum 20, moisture contained in the outside air may permeate into the object. Furthermore, when the moisture that has evaporated from the object is supplied back to the outside, it makes the dehumidification inefficient. Accordingly, when the current flowing to the motor 31 exceeds a predetermined current magnitude (a current applied when there is nothing in the drum), the controller 400 may hold off the dehumidification mode even when the open fluid path is formed by satisfying the condition in 1103.

That the open fluid path may be formed by opening the door 30 or by the dehumidification unit 100 was already described above. In this regard, the controller 400 may determine whether the open fluid path has been formed in different occasions when the dehumidification unit 100 is and is not installed. This will now be described in detail with reference to FIGS. 12 to 13.

Figure 12:
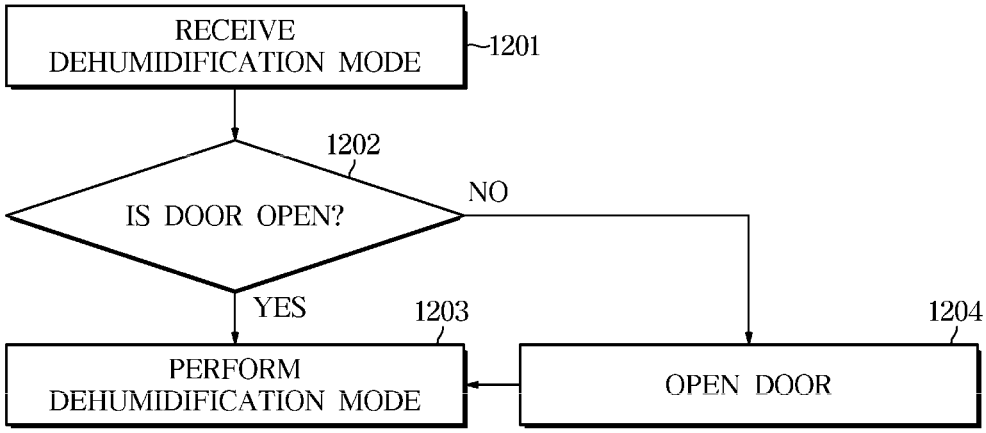
FIGS. 12 and 13 are flowcharts for describing the flowchart of FIG. 11 in more detail.
Figure 13:
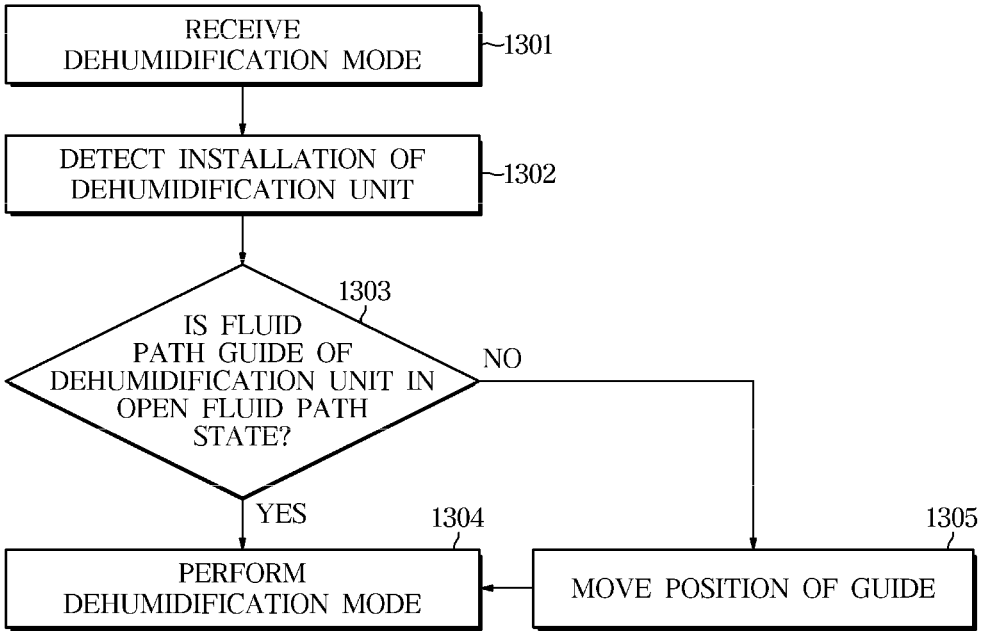

FIGS. 12 and 13 are flowcharts for describing the flowchart of FIG. 11 in more detail.

Referring to FIG. 12, the controller 400 receives a selection command for the dehumidification mode in 1201 and determines whether the door 30 is open in 1202.

The controller 400 may determine whether the door 30 is open or closed, based on an electric signal sent from the door open/close sensor 410.

In an embodiment, the dryer 1 may further include the door open/close sensor outputting a door open or close signal to detect open or closed state of the door. The controller 400 may control the fan 80 based on the door open/close signal received from the door open/close sensor 410. The door open/close sensor 410 is equipped with a switch (not shown) including at least one contact to pass or block an electric signal. The door open/close signal is generated when the door 30 is open and the contact of the switch is in an open state, or when the door 30 is closed and the contact of the switch is in a short-circuited state, i.e., a conductive state.

When the door 30 is open, the controller 400 may determine that the air is flowing in and out through the front opening of the drum 20, forming the open fluid path, and when the door 30 is closed, the controller 400 may determine that the air is not flowing in and out, forming the close fluid path.

When the door 30 is open, the controller 400 controls to perform the dehumidification mode through the open fluid path, in 1203.

When the door 30 is closed, the controller 400 determines that the dehumidification mode is not available and does not perform the dehumidification mode. A door opening device (not shown) is equipped in the dryer 1 for allowing the door 30 to be open even without the users pulling force, and the controller 400 may control the door 30 to be automatically open in order to perform the dehumidification mode. Accordingly, the dryer 1 may perform the dehumidification mode. The controller 400 may control the door opening device in response to an operation signal received from the input device 17. For example, in response to a signal to operate the dehumidification mode provided from the input device 17, the controller 400 may determine that the door 30 is closed when the contact of the switch is in the short-circuited state before controlling the fan 80, and may then control the door opening device. Accordingly, the dryer 1 may be switched to have the open fluid path from the closed fluid path.

Referring to FIG. 13, the controller 400 receives a selection command for the dehumidification mode in 1301 and detects installation of the dehumidification unit 100 in 1302. When detecting that the dehumidification unit 100 is not installed in the dryer 1 but the filter unit 50 is installed, the controller 400 may perform a process according to whether the door 30 is open based on the fact that it is not possible to form the open fluid path according to the dehumidification unit 100 (in 1202 of FIG. 12).

In the following description, it is assumed that the dehumidification unit 100 is installed in the dryer 1.

The controller 400 determines whether the fluid path guide 230 of the dehumidification unit 100 is in the open fluid path state, in 1303. The controller 400 may determine whether the open fluid path has been formed based on a result of detection in the fluid path position detection sensor 430. Specifically, the controller 400 may determine whether the open fluid path or the closed fluid path has been formed according to a position of the fluid path guide 230.

When the dehumidification unit 100 forms the open fluid path, the controller 400 controls to perform the dehumidification mode through the open fluid path, in 1304. In this case, the fluid path guide 230 arranged in the dehumidification unit 100 may be in the first position P1.

When the dehumidification unit 100 forms the closed fluid path, the controller 400 determines that the dehumidification mode is not available and does not perform the dehumidification mode. In this case, the controller 400 may control the fluid path guide 230 to be moved from the second position P2 to the first position P1, in 1305. Accordingly, the dehumidification unit 100 is switched to have the open fluid path from the closed fluid path, and the dryer 1 may perform the dehumidification unit 100.

the controller 400 may control the fan 80 based on a position detection signal received from the fluid path position detection sensor 430. The controller 400 may control the fluid path position switching device in response to an operation signal received from the input device 17.

The fluid path position detection sensor 430 detects a position (first position or second position) of the fluid path guide 230, and generates and provides a position detection signal to the controller 400. Upon reception of the position detection signal indicating that the fluid path guide 230 is in the first position P1, the controller 400 may control the fan 80 to perform the dehumidification mode.

When the controller receives the position detection signal indicating that the fluid path guide 230 is in the second position P2, the controller 400 may move the fluid path guide 230 from the second position P2 to the first position P1 to form the open fluid path before controlling the fan 80. After this, when the fluid path guide 230 is moved to the first position P1, the controller 400 may control the fan 80 to perform the dehumidification mode. According to the disclosure, the dryer 1 may have better dehumidification efficiency and convenience with user equipment (not shown) and an external device (now shown) in addition to effectively performing the dehumidification function by figuring out a condition to perform the dehumidification mode.

In an embodiment, the dryer 1 may include a communication device (not shown) for transmitting or receiving data to or from the user equipment and external device (e.g., an air conditioner, a washing machine, a refrigerator, etc.). Specifically, the dryer 1 may include a communication circuit for communication with an external server, and the external server may transmit or receive data to or from the user equipment and external device. For example, the user may remotely control the dryer 1 through the user equipment.

The communication device may include a local wireless communication module capable of wirelessly exchanging data with an external device within a relatively short range. The local wireless communication module may perform communication based on a communication standard e.g., wireless fidelity (Wi-Fi), Bluetooth, Zigbee, etc.

In an embodiment, the dryer 1 may receive temperature information and humidity information from the user equipment and/or the external device. In this case, the dryer 1 may receive the humidity information, and display, through the dryer 1, an indication recommending the dehumidification mode on the display device 17*b*. The indication recommending the dehumidification mode may notify the user, through the user equipment in addition to the display device 17*b* equipped in the dryer 1, that dehumidification is required around the dryer 1. The temperature information or the humidity information may be provided through a sensor equipped in the dryer 1 itself, or by using data provided from an external device.

Furthermore, according to an embodiment, when the dehumidification mode is being performed while the door 30 is open, the dryer 1 may allow a remote command for the dehumidification mode from the user equipment. In general, the dryer 1 may allow the remote control command only when the door 30 is closed for safety. However, when the dryer 1 is performing the dehumidification mode, the controller 400 may allow the remote control command through the user equipment even while the door 30 is open, in consideration of exceptional conditions. When the dehumidification mode is performed by a command from a user input in response to an operation signal received from the input device 17*b*, the dryer 1 operates the drum 20, the heat exchanger 70, the compressor 73, and the fan 80 until a predetermined time elapses regardless of outside humidity. According to the embodiment, the user may stop the dehumidification mode at any time by transmitting, to the dryer 1, a remote control command through the user equipment even while the dehumidification mode is being performed.

Meanwhile, the embodiments of the disclosure may be implemented in the form of a recording medium for storing instructions to be carried out by a computer. The instructions may be stored in the form of program codes, and when executed by a processor, may generate program modules to perform operation in the embodiments of the disclosure. The recording media may correspond to computer-readable recording media.

The computer-readable recording medium includes any type of recording medium having data stored thereon that may be thereafter read by a computer. For example, it may be a read only memory (ROM), a random access memory (RAM), a magnetic tape, a magnetic disk, a flash memory, an optical data storage device, etc.

The embodiments of the disclosure have thus far been described with reference to accompanying drawings. It will be obvious to people of ordinary skill in the art that the present disclosure may be practiced in other forms than the embodiments as described above without changing the technical idea or essential features of the present disclosure. The above embodiments are only by way of example, and should not be interpreted in a limited sense.

What is claimed is:

1. A dryer comprising:

a main body having an opening for an object to be dried to be entered therethrough;

a drum arranged inside the main body and configured to accommodate the object entered thorough the opening;

a door configured to open or close the opening;

an input device configured to receive an input to perform a dehumidification mode, and output a control signal corresponding to the received input;

a heat exchanger configured to heat air supplied to the drum;

a fan configured to form a flow of air along a fluid path connected to the drum through the heat exchanger from outside of the main body; and a controller configured to control the fan to introduce air from the outside of the main body to flow along the fluid path in response to the control signal received from the input device; and a dehumidification unit including:

a first fluid path to guide the introduced air from the outside of the main body to the heat exchanger, a second fluid path to guide air discharged from the from to the heat exchanger, a fluid path guide configured to be in a first position to provide the first fluid path or in a second position to provide the second fluid path, and a fluid path position detecting sensor configured to detect a position of the fluid path guide, and output a fluid path position detection signal in response to the detected position of the fluid path guide, wherein the controller is configured to control the fan based on the position detection signal received from the fluid path position detecting sensor.

2. The dryer of claim 1, further comprising a door sensor configured to detect an open/close state of the door, and output a door open signal or a door close signal in response to the detected state of the door, and wherein the controller is configured to control the fan based on the door open signal or the door close signal received from the door sensor.

3. The dryer of claim 2, further comprising a display device configured to display operation information of the dryer, wherein the controller is configured to control the display device to display information about the detected state of the door based on the door open signal or the door close signal received from the door sensor.

4. The dryer of claim 1, further comprising a fluid path position switching device configured to move the fluid path guide from the first position to the second position or from the second position to the first position, wherein the controller is configured to control the fluid path position switching device in response to the control signal received from the input device.

5. The dryer of claim 1, further comprising a motor configured to provide power to rotate the drum, wherein the controller is configured to control the motor to rotate the drum in response to the control signal received from the input device.

6. The dryer of claim 5, further comprising a motor current sensor configured to output a motor current signal corresponding to a current applied to the motor, wherein the controller is configured to control the motor to stop a rotation of the drum based on the motor current signal received from the motor current sensor.

7. The dryer of claim 1, further comprising a communication circuit configured to communicate with an external server, wherein the controller is configured to receive a remote control command from the external server in response to the control signal received from the input device.

8. A method for controlling a dryer including:

a main body having an opening for an object to be dried to be entered therethrough, a drum arranged inside the main body to accommodate the object to be dried entered through the opening, a door to open or close the opening, a heat exchanger to heat air supplied to the drum, a fan to form a flow of air along a fluid path connected to the drum through the heat exchanger from outside of the main body, an input device to receive an input to operate the dryer, and a dehumidification unit including:

a first fluid path to guide the introduced air from the outside of the main body to the heat exchanger, a second fluid path to guide air discharged from the drum to the heat exchanger, a fluid path guide configured to be in a first position to provide the first fluid path or in a second position to provide the second fluid path, and a fluid path position detection sensor configured to detect a position of the fluid path guide, and output a fluid path position detection signal in response to the detected position of the fluid path guide, the method comprising:

by the input device, receiving an input to perform a dehumidification mode and outputting a control signal corresponding to the received input; and controlling the fan, by a controller, to introduce air from the outside of the main body to flow along the fluid path in response to the control signal received from the input device, and based on the position detection signal received from the fluid path position detecting sensor.

9. The method of claim 8, wherein the dryer further comprises a door sensor, and the method further comprises:

by the door sensor, detecting an open/close state of the door and outputting a door open signal or a door close signal in response to the detected state of the door; and controlling the fan, by the controller, based on the door open signal or the door close signal received from the door sensor.

10. The method of claim 9, the dryer further comprises a display device to display operation information of the dryer, and the method further comprises controlling the display device to display information about the detected state of the door based on the door open signal or the door close signal received from the door sensor.

11. The method of claim 8, the dryer further comprises a fluid path position switching device configured to move the fluid path guide from the first position to the second position or from the second position to the first position, and the method includes controlling the fluid path position switching device in response to the control signal received from the input device.

12. The method of claim 8, the dryer further includes a motor providing power to rotate the drum, and the method further includes controlling the motor to rotate the drum in response to the control signal received from the input device.

13. The method of claim 12, the dryer further includes a motor current sensor outputting a motor current signal corresponding to a current applied to the motor, and the method further includes controlling the motor to stop a rotation of the drum based on the motor current signal received from the motor current sensor.

14. The method of claim 8, the dryer further includes a communication circuit communicating with an external server, and the method further includes receiving a remote control command from the external server in response to the control signal received from the input device.

* * * * *